US005901393A

United States Patent [19]

Pepe et al.

[11] Patent Number: 5,901,393

[45] **Date of Patent: *May 11, 1999**

[54] ALTERNATING PRESSURE SUPPORT PAD

[75] Inventors: Gregory J. Pepe, Cheektowaga; Scott A. Endress; Kris Fotevski, both of Blasdell, all of N.Y.; John K. Whitney, Dorado Beach, Puerto Rico

[73] Assignee: Gaymar Industries Inc., Orchard Park, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 08/658,819

[22] Filed: May 31, 1996

[51] Int. Cl.[6] ..... A47C 27/10

[52] U.S. Cl. ..... 5/713; 5/706; 5/710; 5/711

[58] Field of Search ..... 5/706, 710, 711, 5/713

[56] References Cited

U.S. PATENT DOCUMENTS

| | | | |
|---|---|---|---|
| 3,148,391 | 9/1964 | Whitney | 5/343 |
| 3,678,520 | 7/1972 | Evans | 5/91 |
| 3,701,173 | 10/1972 | Whitney | 5/349 |
| 4,292,702 | 10/1981 | Phillips | 5/451 |
| 4,391,009 | 7/1983 | Schild et al. | 5/713 |
| 5,103,518 | 4/1992 | Gilroy et al. | 5/453 |
| 5,243,723 | 9/1993 | Cotner et al. | 5/453 |

*Primary Examiner*—Brian K. Green
*Assistant Examiner*—Robert G. Santos
*Attorney, Agent, or Firm*—Hodgson, Russ, Andrews, Woods & Goodyear, LLP

[57] ABSTRACT

An inflatable support pad wherein a first group of inflatable cells are in flow communication with each other, a second group of inflatable cells are in flow communication with each other, and the cells of the first group of cells are interleaved with the cells of the second group of cells whereby the cells are alternatively inflatable and alternately exhaustible. Seal seam portions or walls which separate adjacent cells have serpentine shapes and are disposed relative to each other to define alternately broad and narrow cell portions. The serpentine shapes are truncated to eliminate or reduce duck-billing.

5 Claims, 3 Drawing Sheets

ALTERNATING PRESSURE SUPPORT PAD

The present invention relates to therapeutic mattresses or pads. More particularly, the present invention relates to mattresses or pads having alternately inflatable or expandable cells actuated by a pressure system.

Art which may be of interest to the present invention includes U.S. Pat. Nos. 3,148,391; 3,678,520; 3,701,173; 4,292,702; 5,103,518; and 5,243,723.

Persons required to lie in bed for extended periods of time suffer the discomforts of general fatigue, muscular pains, and, in some instances, decubitus ulcers or pressure sores. Multiple cell fluid or air mattresses have been employed with a pressure system to alternately shift body support areas from one location to another in order to relieve these conditions. An example of such an alternating pressure support is disclosed in U.S. Pat. No. 3,701,173 to John K. Whitney, one of the inventors of the present application. The inflatable mattress shown in this U.S. Pat. No. 3,701,173, which is hereby incorporated herein by reference, is formed from a pair of plastic sheets attached along seal ribbons to provide first and second banks of sequentially inflatable cells each having a longitudinal section and a plurality of transversely extending finger cells branching therefrom. The finger cells of the first bank are interleaved with the finger cells of the second bank. By alternately inflating and exhausting the adjoining banks of cells, the body support areas are shifted, to thereby increase patient comfort and reduce the likelihood of decubitus ulcers. The seal ribbons or walls between adjacent finger cells are sinusoidal or serpentine in shape, and adjacent sinusoidal walls are related to provide over the length of each cell alternately broad and narrow cell portions to thereby effectively increase the diameter of the cells so that the weight of a patient's body is distributed over a wider area. This allows for a lower pressure (on the order of 25 mm Hg) to be utilized in the cells so that the tendency to form decubitus ulcers may be reduced.

Although the above mattress has worked well for many years, there may be a tendency, especially as mattress height is increased, of the cells to "duck-bill" at the narrow portions thereof as the adjacent cells are inflated, i.e., a tendency of the pressure in the broad portions of the adjacent cells to press on the walls at the corresponding narrow portions and thereby pinch closed or nearly closed the narrow cell portions. This may result in uneven inflation of the cells and may interfere with exhausting of the inflated cells during their "off" cycle. As a result, patient comfort and treatment may suffer.

It is accordingly an object of the present invention to eliminate or reduce this "duck-billing" effect so that the mattress cells may be more evenly inflated and exhausted.

In order to eliminate or reduce this "duck-billing" effect, in accordance with the present invention, seal seams between and defining adjacent cells are provided to have truncated serpentine shapes.

The above and other objects, features, and advantages of the present invention will be apparent in the following detailed description of the preferred embodiment thereof when read in conjunction with the accompanying drawings wherein the same reference numerals denote the same or similar parts throughout the several views.

DETAILED DESCRIPTION OF THE PREFERRED EMBODIMENT

Figure 1:
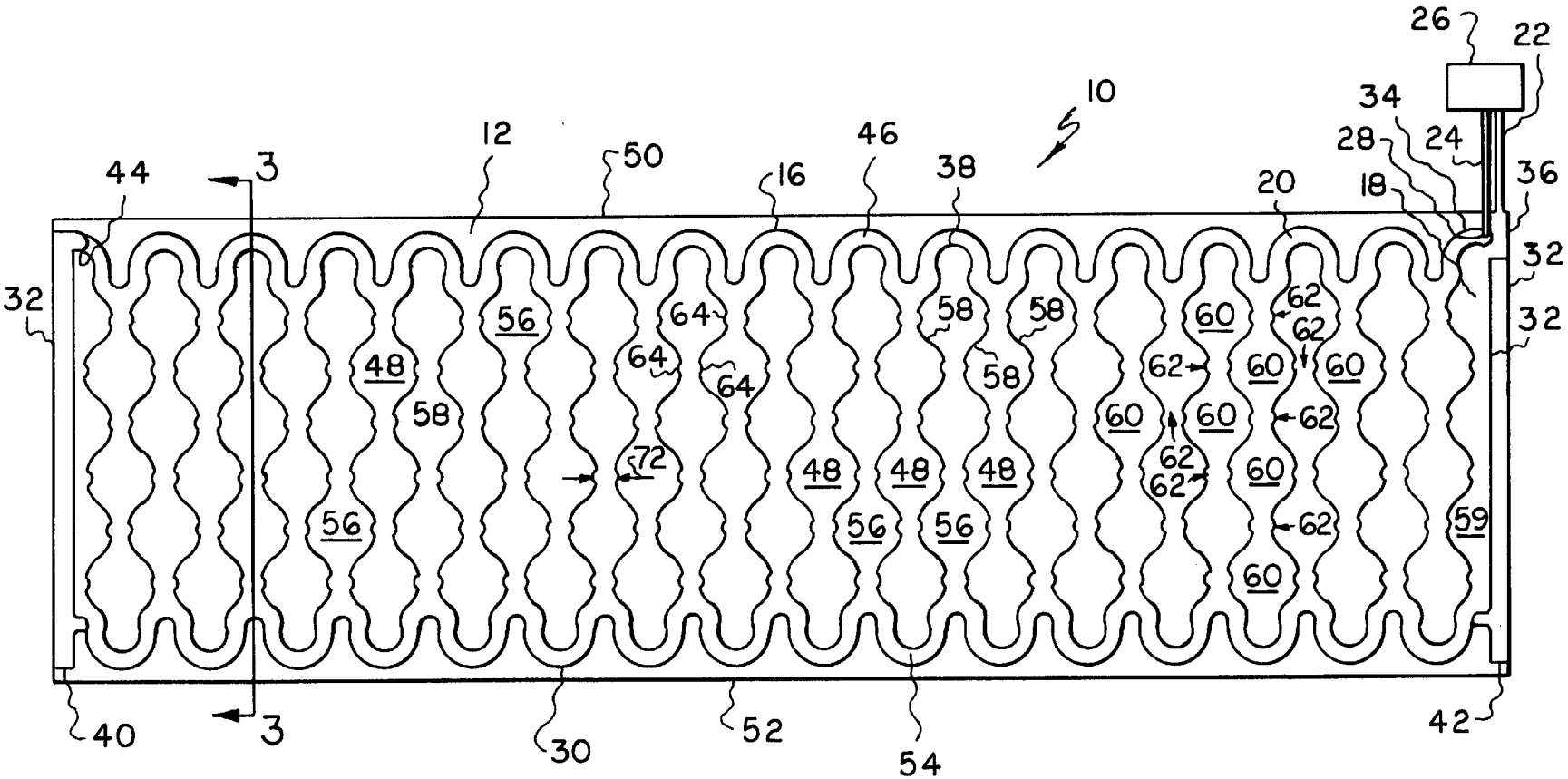
FIG. 1 is a plan view of a support pad, uninflated, which embodies the present invention.

Referring to the drawings, there is illustrated at 10 a pad or mattress for supporting a person. Unless otherwise stated, dimensions provided herein are with the pad uninflated. The pad 10 may, for example, have an overall length of perhaps about 101¾ inches and an overall width of perhaps about 34½ inches suitable for a typical hospital bed. The pad includes upper and lower generally rectangular sheets or webs 12 and 14 respectively of an air-impervious plastic material which are welded or otherwise suitably joined along sealed seams or seal ribbons, illustrated generally at 16, along and within the periphery to define two inflatable chambers, illustrated at 18 and 20 respectively. The chambers 18 and 20 are supplied with air for inflation and exhaustion through lines 22 and 24 respectively by a pressure system, illustrated schematically at 26, including a suitable pump. An example of a suitable pressure system and pump which may be utilized with this pad is shown and described in detail in U.S. Pat. No. 3,462,778, which is hereby incorporated herein by reference. A suitable fitting 28, which is suitably joined to the webs 12 and 14 of plastic material, provides air flow passages between the lines 22 and 24 and the chambers 18 and 20 respectively. A seal seam extends continuously from the fitting 28 along the pad periphery and back to the fitting 28, as illustrated at 30. Thus, first and second seal seam portions 34 and 36 respectively of peripheral seal seam 30 engage the fitting 28. A pair of parallel seal seam portions of peripheral seal seam 30 extend along each of the head and foot ends of the pad 10, as illustrated at 32, defining a closed space therebetween. Although not shown, the pad 10 may, if desired, be constructed to have head and foot end flaps for tucking under an underlying mattress.

Another seal seam 38 has a portion which engages the fitting 28 between the fitting inlets to define the chambers 18 and 20 receiving air through the fitting inlets respectively. Seal seam 38 extends from fitting 28 in a pattern back and forth across the pad 10 between the head and foot ends 40 and 42 respectively and is sealingly joined to the peripheral seal seam 30 at the head end 40, as illustrated at 44, to define the shapes of the chambers 18 and 20 as hereafter described.

Chamber 20 may be defined as having an elongate serpentine-shaped portion or cell 46 which extends from the fitting 28 along one side 50 of the pad 10 to the head end 40 and as having a plurality of elongate portions or finger cells 48 which branch from the common cell 46 and extend transversely across the pad 10, i.e., from side 50 at common cell 46 to closed ends at the other side 52. Likewise, chamber 18 may be defined as having an elongate serpentine-shaped portion or common cell 54 which extends along side 52 of the pad 10 between the foot and head ends 42 and 40 respectively and as having a plurality of elongate portions or finger cells 56 which branch from the common cell 54 and extend transversely across the pad 10 i.e., from side 52 at common cell 54 to closed ends at side 50. One of the finger cells 56, identified at 59, extends along the foot end 42 between the fitting 28 at side 50 and the common cell 54 at side 52. As seen in FIG. 1, finger cells 56 are interleaved with finger cells 48, i.e. finger cells 48 and 56 are disposed to lie with each finger cell 48 between a pair of adjacent finger cells 56 (except of course for the last finger cells at the head and foot ends).

As previously discussed, seal seam 38 forms the boundaries or walls between the finger cells 48 and 56 and therefore define their shapes. The seal seam 38 may be said to have a plurality of seal seam portions 58 each of which extends transversely of the pad 10 between the sides 50 and 52. As seen in FIG. 1, each of the these seal seam portions 58 has a generally sinusoidal or serpentine shape, and each pair of adjacent seal seam portions 58 are disposed in a mirror-image relation to each other so that each of the finger cells 48 and 56 has alternately broad and narrow cell portions illustrated at 60 and 62 respectively. As pointed out in the Whitney' 173 patent, the broad cell portions 60 are resultingly provided to effectively increase the diameter of the cells so that the weight of a patient's body resting thereon is distributed over a wider area. This allows for a lower pressure (on the order of 25 mm Hg) to be utilized in the cells so that the tendency to form decubitus ulcers may be reduced.

Referring again to FIG. 1, it can be seen that each of the narrow cell portions 62 (except of course at the head and foot ends) of a cell of one chamber lies between broad cell portions 60 of the adjacent cells of the other chamber. When air is exhausted from this one chamber and this other chamber is pressurized, the pressure is applied from both sides against the narrow cell portions of the closed chamber so as to tend to create a duck-billing effect whereby the upper and/or lower sheets of material fold inward enough to restrict the air flow through the narrow cell portions and may pinch closed the narrow cell portions 62. This may result in uneven inflation of the cells and may interfere with exhausting the inflated cells during the "off" or exhaust cycle for the corresponding chamber. As the height requirements for the pad 10 increase to, for example, 2½ inches or more, this tendency to duck-bill may become more pronounced. However, reducing the amplitude of the seal seam portions reduces the cell diameter which, as a result, reduces the height.

In order to reduce the tendency of narrow cell portions to duck-bill while substantially maintaining cell diameter, in accordance with the present invention, the serpentine shapes of the seal seam portions 58 are truncated, as illustrated at 64, whereby the smallest distance, illustrated at 72, between adjacent seal seam portions 58 is greater than it otherwise would have been. For purposes of this specification and the claims, the term "truncated" is meant to refer to a blunting or leveling off of a serpentine shape or curve at or along segments thereof where apexes would otherwise occur. For example, the serpentine curve segments 64, which may be called "apex segments," may be reversely curved, i.e., concave instead of convex, as viewed from within the corresponding narrow portion 62, as described hereinafter.

Figure 2:
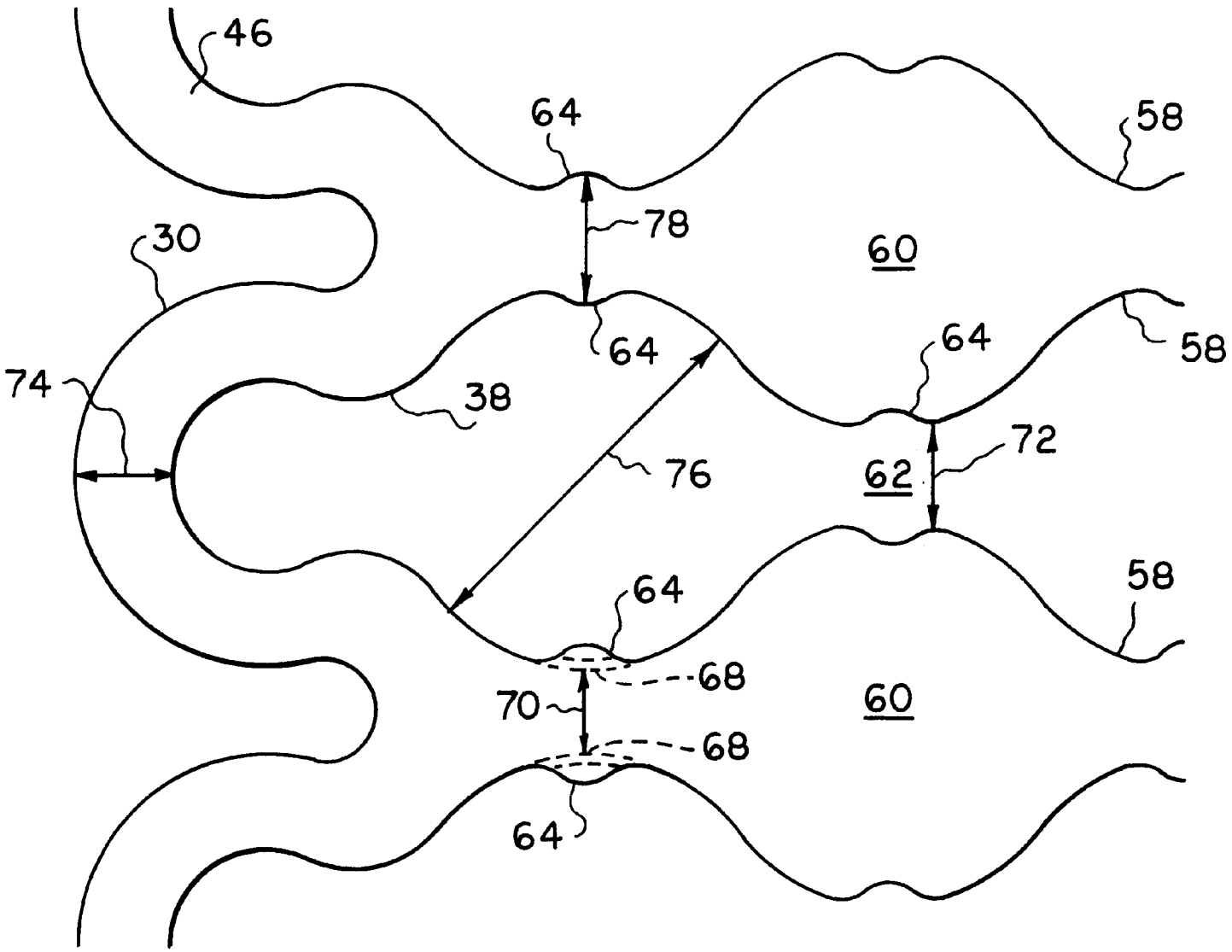
FIG. 2 is an enlarged schematic partial plan view thereof.
Figure 3:
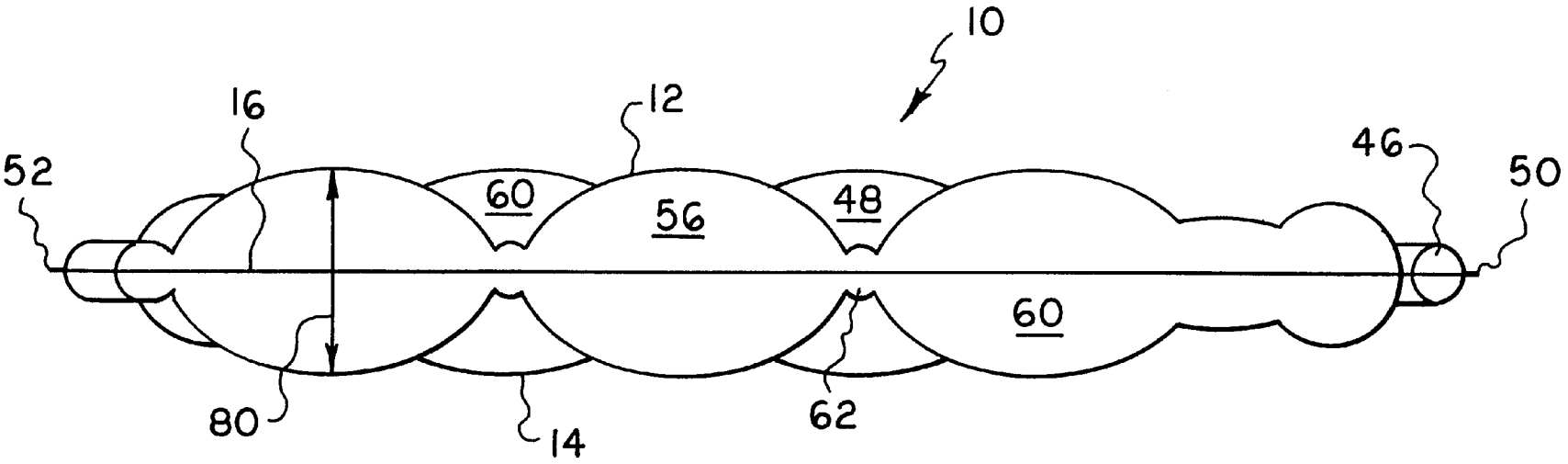
FIG. 3 is a sectional schematic view thereof, inflated, and taken along lines 3—3 of FIG. 1.

Referring to FIG. 2, there is shown an enlarged view of the reversely-curved segments 64. If the segments 64 were not truncated, they would have apexes, as illustrated at 68 in dashed lines, which may be separated from corresponding apexes in adjacent seal seam portions by a distance, illustrated at 70, of perhaps about 0.815 inch. By reversely curving the seal seam portion at or along the segments 64, corresponding segments in adjacent seal seam portion may be separated by a distance, illustrated at 72, of, for example, 1 inch.

The distance, illustrated at 74, between peripheral seal seam 30 and seal seam 38 forming the longitudinally extending common cells 46 and 54 is, in a location between cells branching therefrom, desirably not greater than distance 72, whereby the cross sectional area, inflated, at 74 is not greater than the cross sectional area, inflated, at 72 so that an increased flow and pressure in the common cells 46 and 54 will not contribute to the duck-billing tendency. For example, this distance 74 may perhaps be about 1 inch.

In order to provide a 2½ inch loft (inflated) to the pad 10, as illustrated at 80, the distance, illustrated at 76, across each of the broad cell portions is about 5 inches. For such an exemplary pad 10 as described herein, the distance, illustrated at 78, may, for example, be perhaps about 1.437 inch, and the segments 64 may, for example, have a radius of perhaps about 0.42 inch. The thickness of each of the seal seams 30 and 38 may, for example, be perhaps about 0.16 inch. These dimensions are for the purposes of illustration only and not for purposes of limitation.

Although the invention has been described in detail herein, it should be understood that the invention can be embodied otherwise without departing from the principles thereof, and such other embodiments are meant to come within the scope of the present invention as defined by the appended claims.

What is claimed is:

1. An inflatable support pad comprising upper and lower sheets which are joined along their respective peripheries and along sealed seams interior of the periphery to provide first and second groups of side-by-side elongate inflatable cells, each elongate inflatable cell having a body portion and a terminal end, the cells of said first group being in flow communication with each other, means for inflating and exhausting said first group of cells, the cells of said second group being in flow communication with each other, means for inflating and exhausting said second group of cells, the cells of said first group being interleaved with the cells of said second group whereby the cells are alternatively inflatable and alternatively exhaustible, means defining a plurality of seal seam portions separating adjacent ones of said first and second groups of cells, said separating seal seam portions having a common sidewall for immediately adjacent ones of said first and second groups of cells, wherein the separating seal seam portions are characterized by serpentine shapes and wherein the serpentine shape of immediately adjacent sidewalls of any one of the cells of the respective first and second group of cells have aligned peak portions and aligned trough portions such that the aligned peaks extend toward each other to form a constricted area for a particular one of the cells and the aligned troughs form an open flow, broad area for the one cell, and reversely curved apex segments extending toward an interior of the other of the first and second cells to thereby broaden out the distance between immediately adjacent reversely curved segments of the one cell by the existence of the reversely curved apex segments in order to avoid the broad cell portion on the body of the cell from expanding into and thereby constricting the narrow cell portion of the adjacent body portion of the cell so the remainder of the cell can be inflated and exhausted.

2. A support pad according to claim 1 further comprising a pair of common cells from which said first and second groups of cells branch respectively, each of said common cells having a cross sectional area, inflated, which is not greater than about a smallest cross sectional area, inflated, of said respective narrow cell portion.

3. A support pad according to claim 1 wherein each of said first and second cells which extend along pad sides has a cross sectional area, inflated, which is not greater than about a smallest cross sectional area, inflated, of said respective narrow cell portion.

4. An inflatable support pad, which comprises:

a) an upper sheet;

b) a lower sheet, wherein the upper and lower sheets are joined along their respective peripheries and along sealed seams interior of the periphery to provide first and second groups of side-by-side elongated inflatable cells, the cells of the first group being in fluid flow communication with each other and the cells of the second group being in fluid flow communication with each other and wherein the periphery of the support pad provides spaced apart first and second sides extending to and meeting with first and second ends of the support pad;

c) means for inflating and exhausting the first group of cells in fluid flow communication with a first manifold disposed substantially along the length of at least the first side and in fluid flow communication with the first group of cells;

d) means for inflating and exhausting the second group of cells in fluid flow communication with a second manifold disposed substantially along the length of at least the second side and in fluid flow communication with the second group of cells and wherein the first group of cells is interleaved with the second group of cells interior of the first and second manifolds with the sealed seams providing a common sidewall for immediately adjacent first and second cells, the sealed seam having a generally sinusoidal shape extending from the first manifold to a turn-around forming a portion of the second manifold and then assuming a generally sinusoidal shape extending to a turn-around forming a portion of the first manifold to thereby define one of the first group of cells and the sealed seam continuing in a generally sinusoidal shape extending to a turn-around forming a portion of the second manifold to thereby define one of the second cells and thereby continuing in a alternating pattern extending from the first end of the support pad to the second end thereof, wherein the sinusoidal shape of immediately adjacent sinusoidal sidewalls of the sealed seam of any one of the cells of the respective groups of the first and second cells between the first and second ends has aligned peak portions and aligned trough portions such that the aligned peaks extend toward each other to form a constricted area for a particular one of the cells and the aligned troughs form an open flow, broad area for the one cell; and e) reversely curved apex portions extending toward an interior of the other of the first and second cells to thereby broaden out the distance between immediately adjacent reversely curved portions of the one cell by the existence of the reversely curved apex portions to thereby prevent the broad cell portion of the other of the first and second cells immediately adjacent to the one cell and formed in part by the sealed seam forming the one cell from expanding into and thereby constricting the narrow portion of the one cell so that the remainder of that one cell is freely inflated and exhausted.

5. A method for providing an inflatable support pad, comprising the steps of:

(a) providing an upper sheet;

(b) joining a lower sheet to the upper sheet along their respective peripherals and along sealed seams interior of the peripherals to provide first and second groups of side-by-side elongated inflatable cells, the cells of the first group being in fluid flow communication with each other and the cells of the second group being in fluid flow communication with each other and wherein the periphery of the support pad provides spaced apart first and second sides extending to and meeting with first and second ends of the support pad;

(c) providing means for inflating and exhausting the first group of cells and means for inflating and exhausting the second group of cells such that the first group of cells are inflated when the second group of cells are exhausted;

(d) interleaving teh first group of cells with teh second group of cells with the sealed seams providing a common sidewall for immediately adjacent once of the first and second group of cells, the sealed seam having a generally sinusoidal shape extending from the first manifold to a trun-around forming a portion of the second manifold and then assuming a generally sinusoidal shape extending to a turn-around forming a portion of the first manifold to thereby define one of the first group of cells and the sealed seam continuing in a generally sinusoidal manifold to thereby define one of the second cells and thereby continuing in an alternating pattern extending from the first end providing the sinusoidal shape of immediately adjacent sinusoidal sidewalls of the sealed seam of any one of the cells of the respective groups of the first and second cells between the first and second ends having aligned peak portions and aligned trough portions such that the aligned peaks extend toward each other to form a constricted area for a particular one of the cells and the aligned troughs form an open flow, broad area for the one cell; and (e) providing reversely curved apex portions extending toward an interior of the other of the first and second cells to thereby broaden out the distance between immediately adjacent reversely curved portions of the one cell by the existence of the reversely curved apex portions to thereby prevent the broad cell portion of the other of the first and second cells immediately adjacent to the one cell and formed in part by the sealed seam forming the one cell from expanding into and thereby constricting the narrow portion of the one cell so that the remainder of that one cell is freely inflatable and exhaustable.

* * * * *